United States Patent [19]

Hitchins

[11] Patent Number: 4,583,332

[45] Date of Patent: Apr. 22, 1986

[54] GABLE OVERHANG

[76] Inventor: William G. Hitchins, "Fiddawn", New Cascade Road, 2899

[21] Appl. No.: 758,084

[22] Filed: Jul. 23, 1985

[30] Foreign Application Priority Data

Jul. 23, 1984 [AU] Australia ..... 6166/84

[51] Int. Cl.[4] ..... E04B 1/34; E04B 7/02

[52] U.S. Cl. ..... 52/73; 52/90; 52/92; 52/94

[58] Field of Search ..... 52/73, 90, 94

[56] References Cited

U.S. PATENT DOCUMENTS

| | | | |
|---|---|---|---|
| 657,987 | 9/1900 | Kramer | 52/90 X |
| 1,230,887 | 6/1917 | Gilbert | 52/90 X |
| 1,375,402 | 4/1921 | McAvoy | 52/90 |
| 1,532,695 | 4/1925 | Harting et al. | 52/643 X |
| 3,135,070 | 6/1964 | Waring et al. | 52/90 X |
| 3,332,180 | 7/1967 | Price | 52/94 |
| 3,783,562 | 1/1974 | Eysenring | 52/73 X |
| 3,881,286 | 5/1975 | Smith et al. | 52/90 |
| 3,979,862 | 9/1976 | Hamilton et al. | 52/90 |
| 4,179,857 | 12/1979 | Danford | 52/73 X |

FOREIGN PATENT DOCUMENTS

| | | | |
|---|---|---|---|
| 1434042 | 11/1960 | Fed. Rep. of Germany | 52/90 |
| 3318330 | 12/1984 | Fed. Rep. of Germany | 52/73 |
| 987706 | 4/1951 | France | 52/90 |

*Primary Examiner*—Alfred C. Perham
*Attorney, Agent, or Firm*—Anthony A. O'Brien

[57] ABSTRACT

An overhanging gable structure for buildings in which the overhanging gable is supported by a series of tubular metal members which are secured within brackets that are attached to the frame of the building and disposed between the top plate of an outer wall of the building and the line of the rafters of the roof of the building.

5 Claims, 4 Drawing Figures

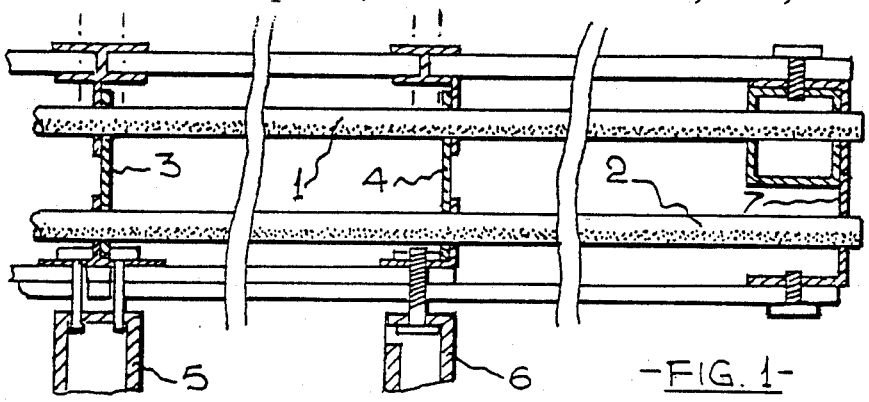
-FIG. 1-
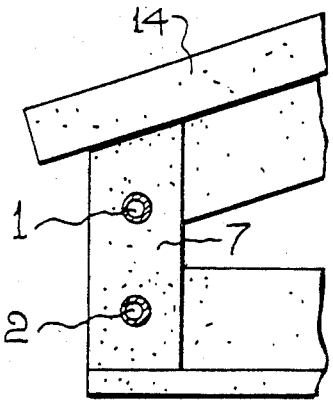
-FIG. 3-
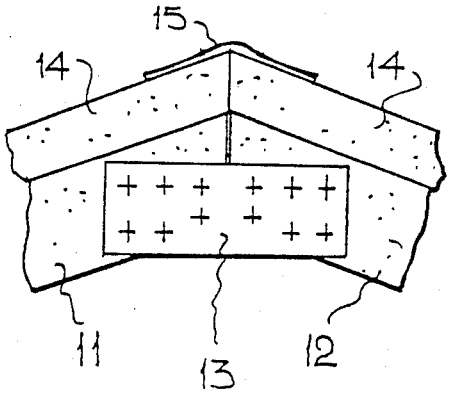
-FIG. 4-
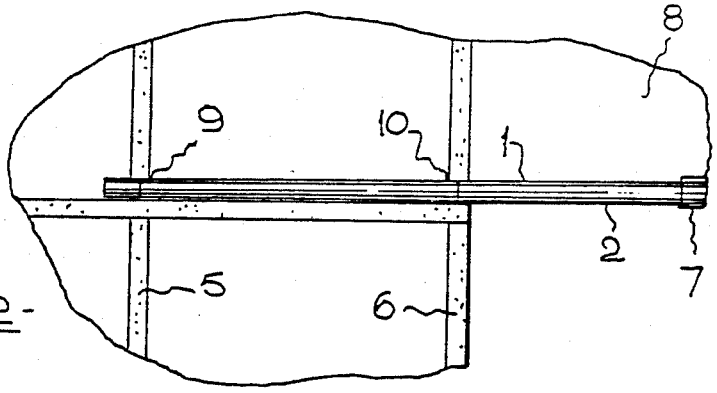
-FIG. 2-

GABLE OVERHANG

This invention relates to building construction and more particularly to roof structures, having to do especially with gable ends.

Simply stated, a gable roof may be described as a "roof having two sides sloping up to a centre ridge" and, in a conventional gable roof, an end may overhang an associated gable by, say, 12 to 15 inches. However, for certain purposes, —practical, aesthetic or otherwise—it may be desirable or necessary to construct a gable roof with an overhang of up to, perhaps, 48 inches and this presents certain problems in the building thereof.

In standard roof frame construction, the top plates of the outer walls of a building may be spanned by ceiling joists or tiebeams. Kingposts are erected vertically on the tiebeams, these kingposts having their upper ends fixed to a ridgeboard. In an alternate type of construction, prefabricated triangular roof trusses may be erected on the top plates and the apices of these trusses connected by the ridgeboard, to which the top ends of the rafters are nailed. The lower ends of the rafters may be arranged so as to overhang the outside walls, these lower ends being cut vertically and spanned by a fascia to thus constitute the eaves. To complete the roof frame, purlins are laid across the rafters to permit the roof cladding to be put on. Usually, at each gable end, the ridgeboard will extend somewhat beyond the end walls, and the side fascias will also extend to the same distance at each end to allow end fascias to be added to complete the gable ends of the roof frame.

The spaces between walls and fascias, all around the building, are generally filled in with suitable cladding material. Sometimes a triangular bargeboard may be fitted so as to span the space between the fascia and the ridgeboard ends, such a bargeboard often becoming a vehicle for decoration.

From the above, it will have become clear that to produce a gable overhang of 3 or 4 feet, the end parts of the roof timbers—ridgeboard, purlin and side fascia ends—will have to be cantilevered out over the gable ends in a manner intrinsically flimsy and insubstantial.

It is therefore an object of the present invention to overcome the above and other disadvantages, and to this end there is thus provided, according to the present invention, an overhanging gable structure, comprising a plurality of brackets each one of which is mounted atop a stud of a frame of a building so as to be disposed between a top plate of an outside wall of the said building and the line of rafters of a roof thereof; apertures formed in each said bracket; and a plurality of tubular metal members extending in spaced-apart relationship through said apertures so that the longitudinal axis of each said tubular metal member is disposed horizontally and parallel to the said outside walls; the arrangement being such that, while the fixed ends of said tubular metal members are held in the apertures in the said brackets, free ends of the said tubular metal members are cantilevered out from said building to terminate, in like spaced-apart relationship, in housings mounted beneath said roof frame so as to provide support for a said overhanging gable.

Preferably, each tubular metal member is a circular-sectioned tube of from about 1¼ inch to 1½ inch in diameter, and may well extend through at least two of the brackets. Four of the pipes may be used to support the overhang, two at each side.

Ideally, the overhang exterior is provided with conventional fascias which overlie the housings.

In order that the reader may gain a better understanding of the present invention, hereinafter will be described a preferred embodiment thereof, by way of example only, and with reference to the accompanying drawings in which:

FIG. 1 is a side elevation, partially in vertical cross-section, of the construction of a gable overhang according to the present invention;

FIG. 2 is a schematic side view showing how best a pipe may be bracketted;

FIG. 3 is an end elevation; and

FIG. 4 illustrates an inventive overhanging gable with gangnailed overlying fascias.

FIG. 1 shows a pair of tubular metal members in the form of 1¼ inch to 1½ inch diameter tubes or pipes 1 and 2. The inner, or fixed ends of each pair of pipes are held in position by being passed through appropriate apertures in a plurality of brackets, such as those referenced 3 and 4, each of these brackets being mounted atop a stud, such as those referenced 5 and 6, of a frame of a building. These studs 5, 6 may be conventional timber studs or, as shown, they could well be two-apart structural components such as those described and claimed in the specification relating to Australian Patent Application No. 72,778/81.

The "free" ends of each pair of pipes 1, 2 are cantilevered outwardly from the building to terminate and be held in a like spaced-apart relationship in a housing 7 mounted beneath the roof frame. As will be seen, the two tubular metal members have their longitudinal axes disposed horizontally and parallel to the outside walls of the building. The cantilevered portions of the tubular metal members thus provide support for the overhanging gable end.

As is shown in FIG. 2, to achieve a firmly-anchored gable overhang 8, the pipes 1 and 2 should be bracketted at at least two—and preferably more—points along their lengths, as at the locations referenced 9 and 10.

In FIG. 3, which is an end elevation, the "free" ends of pipes 1 and 2 are shown held in housing 7; 14 represents a gable-end rafter.

FIG. 4 is a fragmentary end elevation showing the exterior of the overhang provided with conventional fascias 11 and 12 which may be simply joined together by means of a gangnail 13; alternatively, the facias or gable end rafters may be joined by means of a plate affixed thereto by pop rivets or screws, which may or may not be self-driving. Gable-end rafters 14 are provided with a suitable ridge-capping member 15, of, say, iron, lead, asbestos cememt, tile, or the like.

The achieving of a large gable overhang on a building such as a dwelling house permits, as an example only, the incorporation of such a feature as a "porte-cochere" without the need for supporting pillars which are all too easily damaged by motor vehicles drawing up beneath the structures supported thereby.

From the above-going, the reader will readily appreciate that gable overhangs constructed in accordance with the present invention provide the public with a new or much improved facet of building construction or, at the very least, offer to it a useful and most attractive choice.

The claims defining the invention are as follows.

I claim:

1. An overhanging gable structure, comprising a plurality of brackets each one of which is mounted atop a stud of a frame of a building so as to be disposed between a top plate of an outside wall of the said building and the line of rafters of a roof thereof; apertures formed in each said bracket; and a plurality of tubular metal members extending in spaced-apart relationship through said apertures so that the longitudinal axis of each said tubular metal member is disposed horizontally and parallel to the said outside walls; the arrangement being such that, while the fixed ends of said tubular metal members are held in the apertures in the said brackets, free ends of the said tubular metal members are cantilevered out from said building to terminate, in like spaced-apart relationship, in housings mounted beneath said roof frame so as to provide support for a said overhanging gable.

2. The overhanging gable structure as claimed in claim 1, wherein each tubular metal member comprises a circular-sectioned tube of from $1\frac{1}{4}$ inch to $1\frac{1}{2}$ inch in diameter.

3. The overhanging gable structure as claimed in claim 1, wherein each tubular metal member extends through at least two of said brackets.

4. The overhanging gable structure as claimed in claim 1 including four of said tubular metal members, two at each side of said gable overhang.

5. The overhanging gable structure as claimed in claim 1, wherein the overhang exterior is provided with conventional fascias which overlie said housings.

* * * * *